United States Patent [19]

Wulff

[11] 3,930,277

[45] Jan. 6, 1976

[54] MOBILE FLOOR SWEEPER

[75] Inventor: Richard F. Wulff, Long Lake, Minn.

[73] Assignee: Advance Machine Company, Spring Park, Minn.

[22] Filed: Aug. 21, 1974

[21] Appl. No.: 499,143

[52] U.S. Cl. ..... 15/83
[51] Int. Cl.[2] ..... E01F 1/04
[58] Field of Search ..... 15/49 C, 50 C, 83–86, 15/340

[56] References Cited

UNITED STATES PATENTS

| | | | |
|---|---|---|---|
| 1,042,860 | 10/1912 | Whittome | 15/83 |
| 1,537,003 | 5/1925 | Bryant | 15/83 |
| 2,913,744 | 11/1959 | Gregersen | 15/83 |

*Primary Examiner*—Edward L. Roberts
*Attorney, Agent, or Firm*—Wicks & Nemer

[57] ABSTRACT

A Mobile Floor Sweeper including a rotatable cylindrical brush mounted on a mobile chassis, lever means for raising and lowering said brush relative to the chassis with plate means pivotally mounted on the chassis adjacent the brush together with lever means connecting the plate means with the means for raising and lowering the brush whereby the plate means follows the brush as it is raised and lowered and means for adjustably positioning one end of the brush relative to the chassis.

7 Claims, 4 Drawing Figures

MOBILE FLOOR SWEEPER

SUMMARY

The invention relates to mobile floor sweepers having a cylindrical brush for picking up debris. Certain of such types of sweepers have a plate adjacent the brush to aid in directing the flow of debris over the brush and into a collector bin. However, when the brush is used the diameter of the brush reduces and the same must be replaced or lowered to maintain brushing contact with the floor. When the reduced diameter brush is lowered the space between the plate is increased and the effectiveness of the plate is diminished.

It is an object of the present invention to provide a mechanism which causes the plate to automatically follow the brush as it is lowered and a further mechanism for adjusting an end of the brush to maintain contact of the entire length of the brush with the floor.

With reference to the drawings forming part of this application:

FIG. 1 is a side elevational view of a floor sweeper partially in section with portions broken away and embodying the invention.

Figure 2:
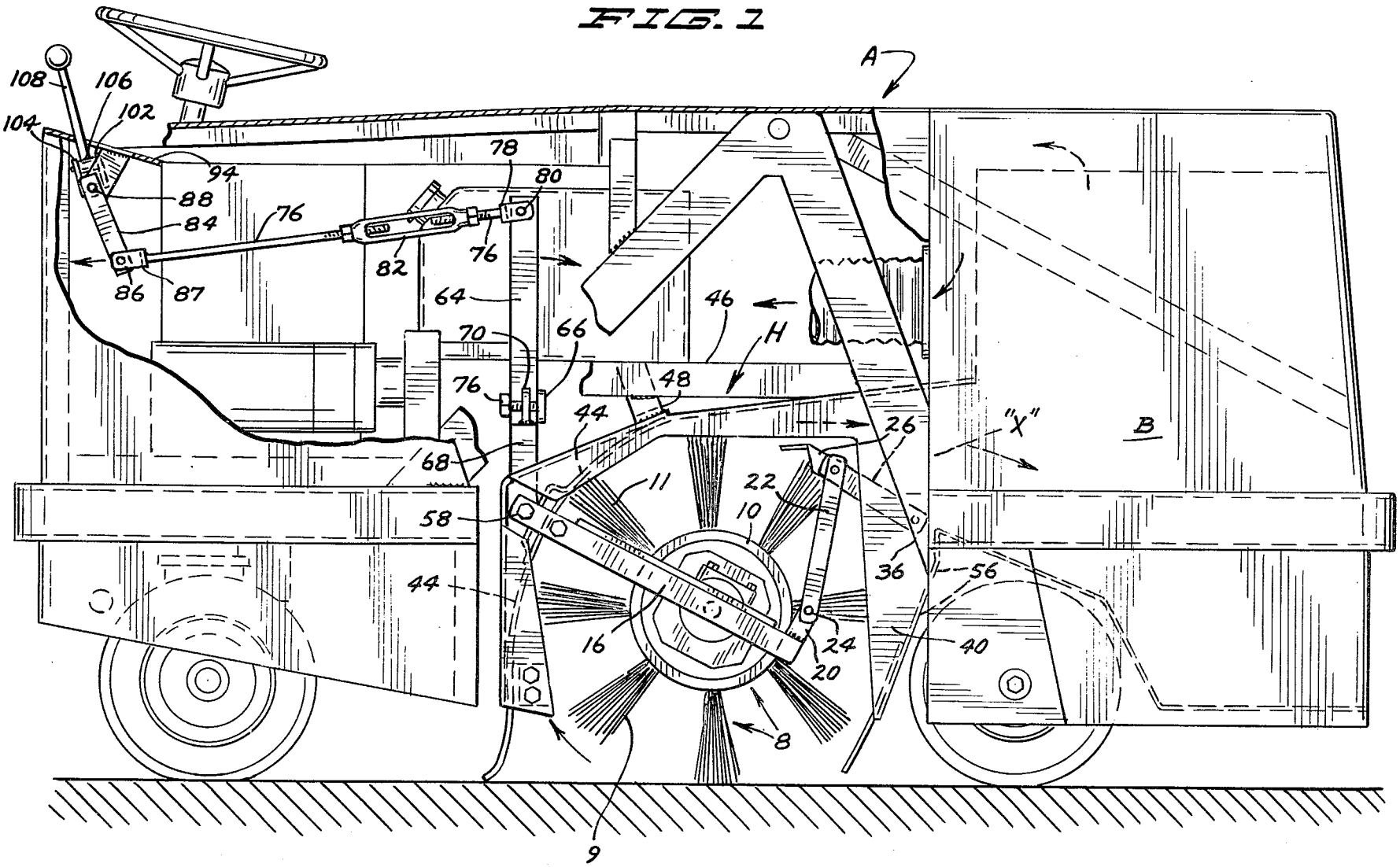
FIG. 2 is a top plan view of the sweeper partially in section with portions broken away.
Figure 2:
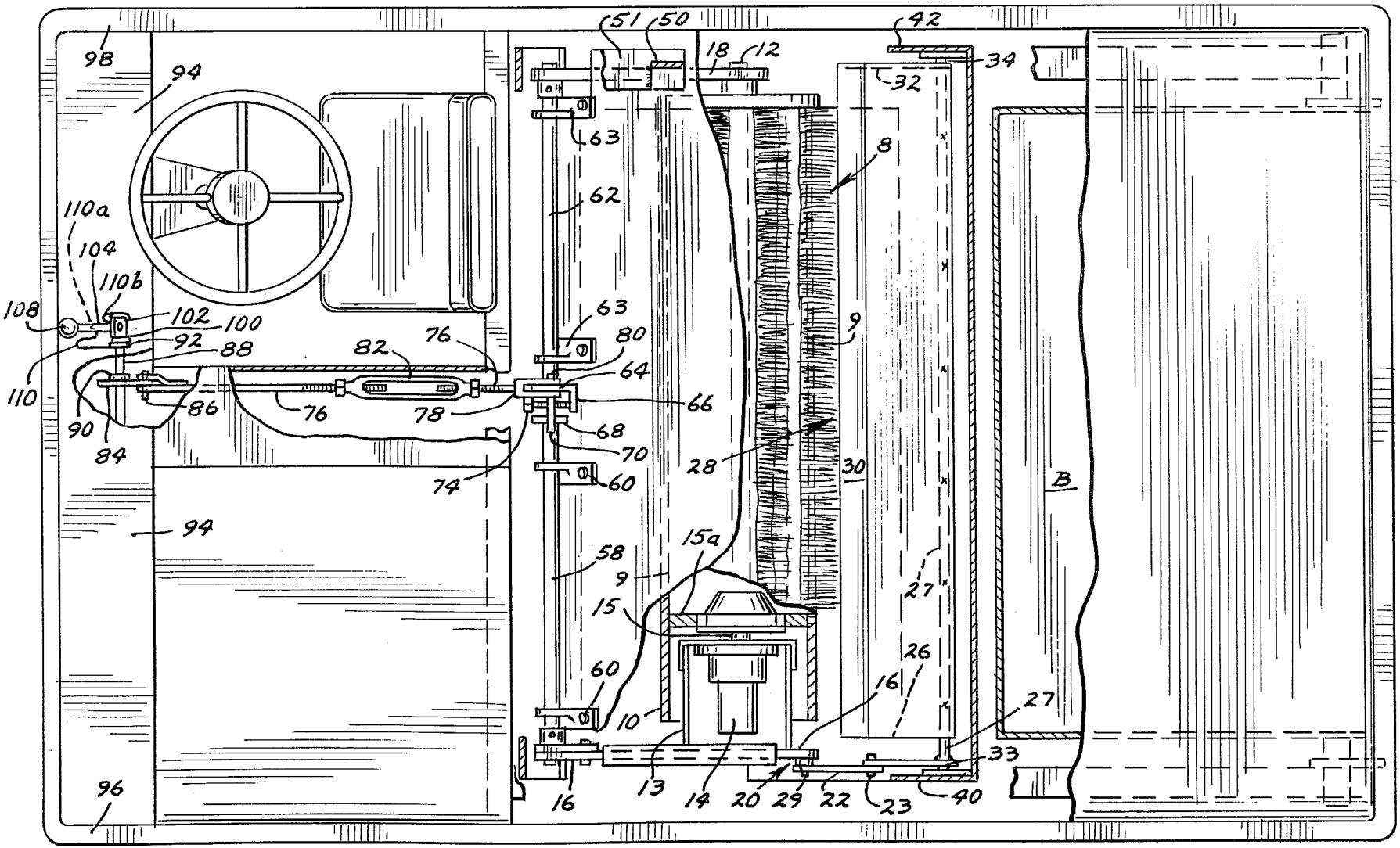

Referring to the drawings in detail, the sweeper A includes the conventional cylindrical brush 8 with the bristles 9 mounted on the core 10. Having a trunnion shaft 12 at one end. Further provided is a motor housing 13 connected to a first side bar 16 with the trunnion shaft 12 rotatably mounted on the second side bar 18. Mounted within the housing 13 is the hydraulic motor 14, the shaft 15 of which is connected to the plate 15a which in turn is connected to the core 10 whereby the brush is rotatable. Rigidly connected to the rear end of the first side bar 16 is the extension 20 to which is pivotally connected at one end the link 22 by means of the pin 24. The other end of the link 22 is pivotally connected by means of the pin 23 to the link 26 with the other end of the link 26 fixedly secured to the rod 27. The numeral 28 designates a follower plate which includes the main flat body 30 secured to the rod 27 at the rear longitudinal edge and from which the side flange 32 extends. The rod 27 extends beyond the side flange 32 and the other end of the plate to form trunnions 33 and 34 respectively, which are journaled in the side wall portions 40 and 42, respectively of the housing H for pivotal movement of the plate 28.

Figures 3, 4:
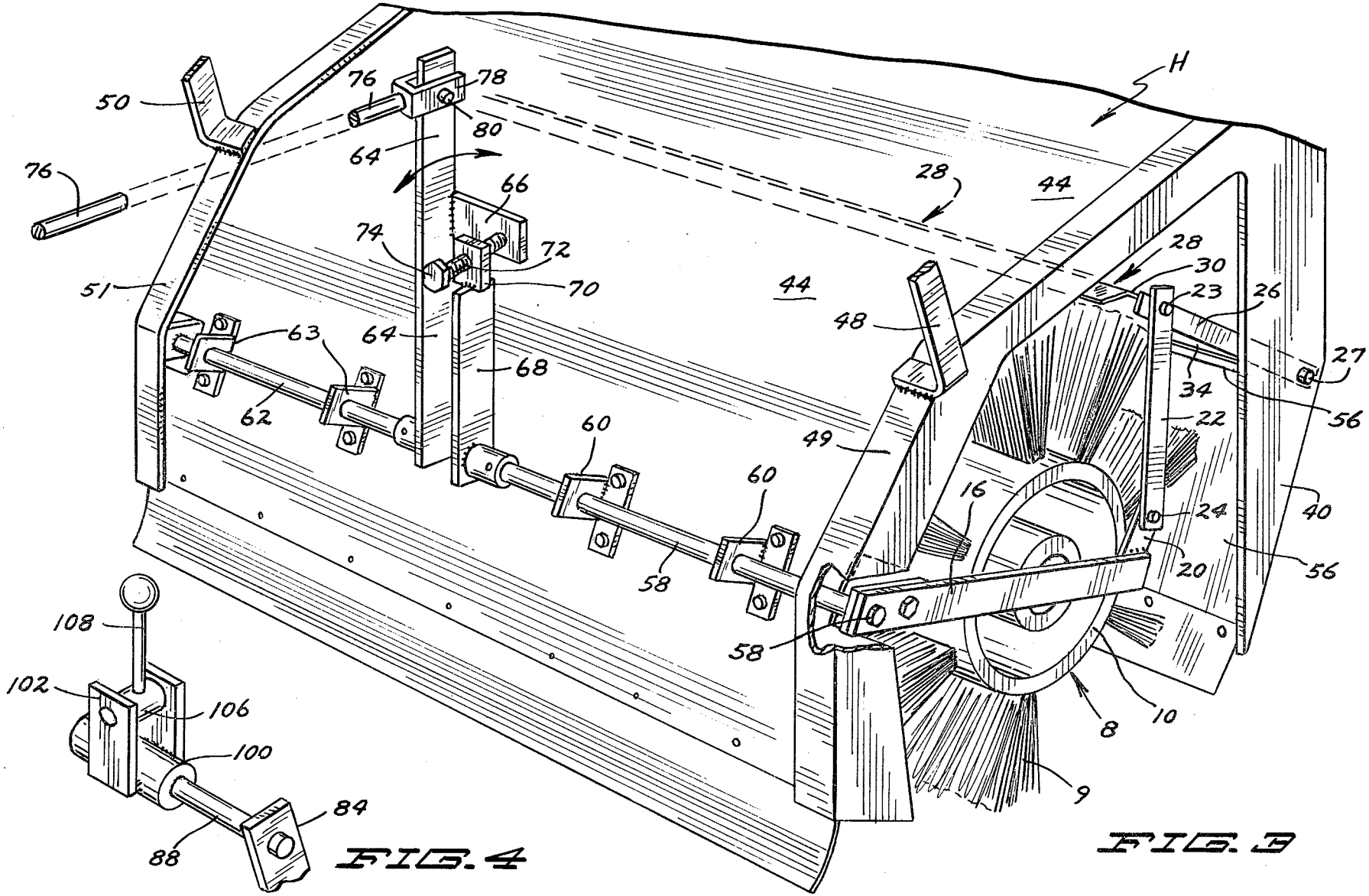
FIG. 3 is a perspective view of the central portion of the sweeper showing in particular the follower deflector plate for the brush and the mechanism therefore embodying the invention.
FIG. 4 is a perspective view of the handle and its mounting for raising and lowering the brush.

The sidewall portions 40 and 42 are connected to the top 44 of the housing H. The housing H is connected to the longitudinal frame 46 by means of the brackets 48 and 50 connected to the braces 49 and 51 carried by the top 44 of the housing. The numeral 56 designates a plate, FIGS. 1 and 3 secured to the side wall portions 40 and 42 which leaves an opening as at "X" between the upper edge of the plate 56 and the housing H through which debris is thrown by means of the brush into the collector bin B as indicated by the arrows in FIG. 1.

The forward end of the first side bar 16 is rigidly secured to the outer end of the first transverse rod 58 which is pivotally mounted in the brackets 60 secured to the top 44 of the housing H. The numeral 62 designates a second transverse rod pivotally mounted in the brackets 63 secured to the top of the housing H and substantially in axial alignment with the first transverse rod 58. The outer end of the rod 62 is fixedly secured to the second side bar 18, and the inner end of rod 62 is fixedly secured to the lower end of the first control arm 64. Secured to and extending from the arm 64 is the extension bar 66. A second control arm 68 is fixedly secured at its lower end to the inner end of the first transverse rod 58, and on the upper end of the arm 68 is the small plate 70 having a threaded hole 72 in which is mounted the threaded adjustment bolt 74. The bolt 74 is of such a length that it adjustably bears against the extension bar 66, the screw movement of the bolt changing the relative position of the bars 64 and 68 and therefore the position of the brush relative to the floor. As the adjustment screw 74 is changed the end of the brush mounted on the bar 16 is raised or lowered relative to the other end of the brush so that there is full lengthwise contact and even pressure of the brush with a surface to be swept. In essence, if the end of the brush at bar 16 is too low or too high relative to the other end, the brush end may be adjusted to level the brush with the floor and give an even sweeping path. This guarantees more even brush wear and complete sweeping. As a result the entire brush may be kept parallel to the floor on which the sweeper is used.

Further provided is the rod 76 which has mounted on the inner end thereof the bifurcated member 78 pivotally connected to the upper end of the arm 64 by means of the pin 80. Mounted on the rod 76 for lengthwise adjustment thereof is the turnbuckle 82. The rod 76 is pivotally connected at its front end to the lower end of arm 84 by means of the pin 86 in the bifurcated end 87. The upper end of the arm 84 is fixedly secured to the short shaft 88 rotatably mounted in the brackets 90 and 92 mounted on the transverse support plate 94 connected to the walls 96 and 98 of the sweeper A.

Further provided is an enlarged portion 100 of shaft 88 to which is secured the spaced ears 102 and 104 and pivotally mounted on the ears 102 and 104 is the collar 106 to which is secured the handle 108. When the handle 108 is moved rearwardly of the sweeper, the shaft 88 is rotated and as a result the arm 84 is moved in the direction of the arrow in FIG. 1 which through the mechanism described raises the brush, and if the handle 108 is moved in the opposite direction the brush is lowered through the mechanism described. To hold the handle in a given position to thereby hold the brush in a given position, there is provided the locking slots 110, 110a and 110b formed in the support plate 94 which receive the handle for adjustably positioning the brush.

OPERATION

In using the sweeper A, the brush 10 wears and the diameter of the same is thereby reduced. With the diameter of the brush reduced, it is necessary to lower the same for maintaining contact with the surface to be swept. To rememdy this the handle 108 is moved forward which moves the arm 84 rearwardly which in turn moves the arm 64 rearwardly in the direction of the arrow through the rod 76 as in FIGS. 1 and 3. As the arm 64 moves rearwardly the rods 58 and 62 are allowed to rotate due to the weight of the brush in a clockwise direction looking particularly at FIG. 1. As the shafts 58 and 62 rotate the bars 16 and 18 are lowered about the axis of rotation of the rods 58 and 62, and as the bars are lowered the plate 28 is pivotally lowered and follows the brush through the links 22 and 26 and the trunnions 27 and 34. As a result the plate 28, particularly the forward edge, is positioned in close proximity to the brush whereby debris picked up by the brush does not travel around with the brush but exits into the bin B through the opening as at "X." With the forward edge of the plate 28 in close proximity to the brush a flow pattern of air and debris is created above the plate 28 and out of the opening as at X. As a result air and debris does not follow around the brush but as above described. As the brush wears further and the same is lowered the plate 28 is automatically and pivotally lowered to maintain its proximity to the brush. Even pressure contact of the brush is maintained by means of the adjustment bolt 74 and the parts connected therewith as hereinbefore set forth.

I claim:

1. In a floor sweeper having a rotatable cylindrical brush mounted on a mobile chassis, a receiver for receiving debris delivered from said brush, means for raising and lowering said brush, a plate adjacent said brush for the direction of debris, the improvement in said plate said improvement including a. plate means carried by said sweeper and adjacent said brush, and b. means for moving said plate means relative to said brush as said brush is moved relative to said chassis whereby the plate means maintains the same position relative to the brush, said means for moving said plate means including link means connected to said plate means and said means for raising and lowering said brush whereby the plate means automatically moves relative to the brush when the brush is raised and lowered.

2. The device of claim 1 in which said plate means includes a flat plate.

3. The device of claim 2 in which said plate is pivotally mounted on the edge on the chassis.

4. In a floor sweeper having a rotatable cylindrical brush mounted on a mobile chassis comprising in combination:

a. means for raising and lowering said brush relative to the chassis, b. plate means, c. means pivotally mounting said plate means on said chassis, adjacent said brush, d. lever means connecting said plate means with said means for raising and lowering said brush whereby the plate means follows the brush as it is raised and lowered, and f. means for adjustably positioning one end of said brush relative to the chassis.

5. The device of claim 4 in which said plate means includes a single flat plate.

6. In a floor sweeper having a rotatable cylindrical brush mounted on a mobile chassis, lever and rod means for raising and lowering said brush, means associated with said lever and rod means for adjustably moving one end portion of said brush relative to the other end, the improvement in said associated means, said improvement including a. said means associated with said lever and rod means including first and second rod members in axial alignment and carried by said mobile chassis, b. a second arm rigidly secured to said second rod means at the inner end, c. said second rod rigidly secured at the outer end to d. a second bar connected to said brush, e. a first arm rigidly secured to said first rod means at the inner end, f. said first rod rigidly secured at the outer end to, g. a first bar connected to said brush, h. means for changing the relative positions of said second and first arms to cause the end portion of said brush connected to said first bar to move relative to the chassis.

7. The device of claim 6 in which said means for changing the relative positions of said second and first arms includes a. a screw member mounted on said first arm in engagement with b. an extension bar on said second arm.

* * * * *